United States Patent [19]

Tjaden

[11] 4,227,571

[45] Oct. 14, 1980

[54] PLATE HEAT EXCHANGER

[75] Inventor: Jan Tjaden, Durach, Fed. Rep. of Germany

[73] Assignee: Internationale Octrooi Maatschappij "Octropa" B.V., Rotterdam, Netherlands

[21] Appl. No.: 934,895

[22] Filed: Aug. 18, 1978

[30] Foreign Application Priority Data

Aug. 26, 1977 [DE] Fed. Rep. of Germany ..... 2738670

[51] Int. Cl.[3] ..... F28F 3/10; F28F 3/12

[52] U.S. Cl. ..... 165/167; 165/170

[58] Field of Search ..... 165/130, 153, 167, 170, 165/173, 177

[56] References Cited

U.S. PATENT DOCUMENTS

| | | | |
|---|---|---|---|
| 881,270 | 3/1908 | Walker | 165/130 |
| 2,616,671 | 11/1952 | Wakeman | 165/167 |
| 2,752,125 | 6/1956 | Modine | 165/130 |
| 3,757,857 | 9/1973 | Merryfurl | 165/170 |

*Primary Examiner*—Stephen Marcus
*Attorney, Agent, or Firm*—Barry Kramer

[57] ABSTRACT

A plate heat exchanger has elements through which a medium flows. The elements are two thin metal plates, in at least one of which passages and opposed manifolds connecting the passages are formed by deep drawing. The plates are coated with a sealing adhesive and bonded together. The manifolds extend across the entire length of the elements and are closed at their ends by end closures inserted in the manifolds and sealed to the plates. Distributing conduits running transversely to the plates of the heat exchange elements, are connected to channels provided in the end closures so that the medium can flow from a distributing conduit through an end closure into a deeper shaped manifold and then into the passages and leave the elements in a corresponding manner. Pipes having a cross-shaped cross-section can be inserted in the end closures to serve as distributing conduits and also as tie-rods to hold the elements of the heat exchanger together.

6 Claims, 7 Drawing Figures

PLATE HEAT EXCHANGER

This invention relates to plate heat exchangers and more particularly to heat exchangers which are made from thin metal sheets or plates coated with sealing adhesive material such as polyethylene and polypropylene to enable said sheets or plates to be bonded together, at least one of said sheet or plates being deep-drawn to provide passages and manifolds through which a medium can flow.

Plate heat exchangers of this type are known in which a plurality of small and parallel passages are at both their ends connected by deeper manifolds extending over the whole length of a heat exchange element. The manifolds are closed at their ends, and distributing conduits are mounted on the manifolds. If the plates of the heat exchanger consist of a thin metal sheet, e.g. of aluminum having a thickness of 0.04 to 0.5 mm., it is difficult to connect manifolds or similar elements forming the distributing conduits to the elements of the heat exchanger without deforming the plates and the deeper manifolds deep-drawn in the plates, respectively.

It is therefore an object of the present invention to provides means for connecting several elements of a plate heat exchanger without deforming the plates of the elements.

The plate heat exchanger according to the present invention comprises one or more heat exchanger elements consisting of two thin metal plates, preferably aluminum having a thickness of 0.04 to 0.5 mm. The metal plates are coated with a sealing adhesive on their sides contacting each other and are bonded together in mutual contact zones. At least one of the plates is deep drawn to form a plurality of parallel shallow passages and, on the opposed ends of said passages, a deeper manifold is provided perpendicular to said passages. The deeper opposed manifolds extend over the whole length of a plate. Sheet material with this pattern can be manufactured in great lengths and the length required can then be cut off to form one element. Deep-drawing of the sheet material can be effected continuously between toothed cylinders forming the passages combined with rotating wheels forming the deeper manifolds.

An end closure is inserted into each end of each of the manifolds of a heat exchange element. The end closures have a cross section which is approximately equal to that of the deeper manifold. The end closures can consist, at least on their outer surfaces, of a material that can be sealed to the sealably coated inner surfaces of the plates. Preferably, the end closures are injection-molded pieces of the same material that is used as the sealing adhesive material for coating the plates. On bonding the plates together, the end closures are sealed to the plates, thereby tightly closing off the ends of the deeper manifolds. The end closures can be provided with apertures and/or channels. The apertures in the end closures correspond to apertures in the plates or pipes or other conduits which run transversely to the plates of the heat exchange elements and through said apertures of the end closures. Because of their shape, the end closures incompressibly fill out the ends of the deeper manifolds around the distributing conduits so as to absorb and compensate for any pressure and/or tensions in the direction of the axis of the distributing conduits without any deformation of the deeper manifolds on assembling the elements as well as under the influence of pressure and temperature of the medium flowing in the exchanger.

The invention will now be further illustrated with reference to the accompanying drawings, in which;

FIG. 4 is another view of an end closure;

Figure 1:
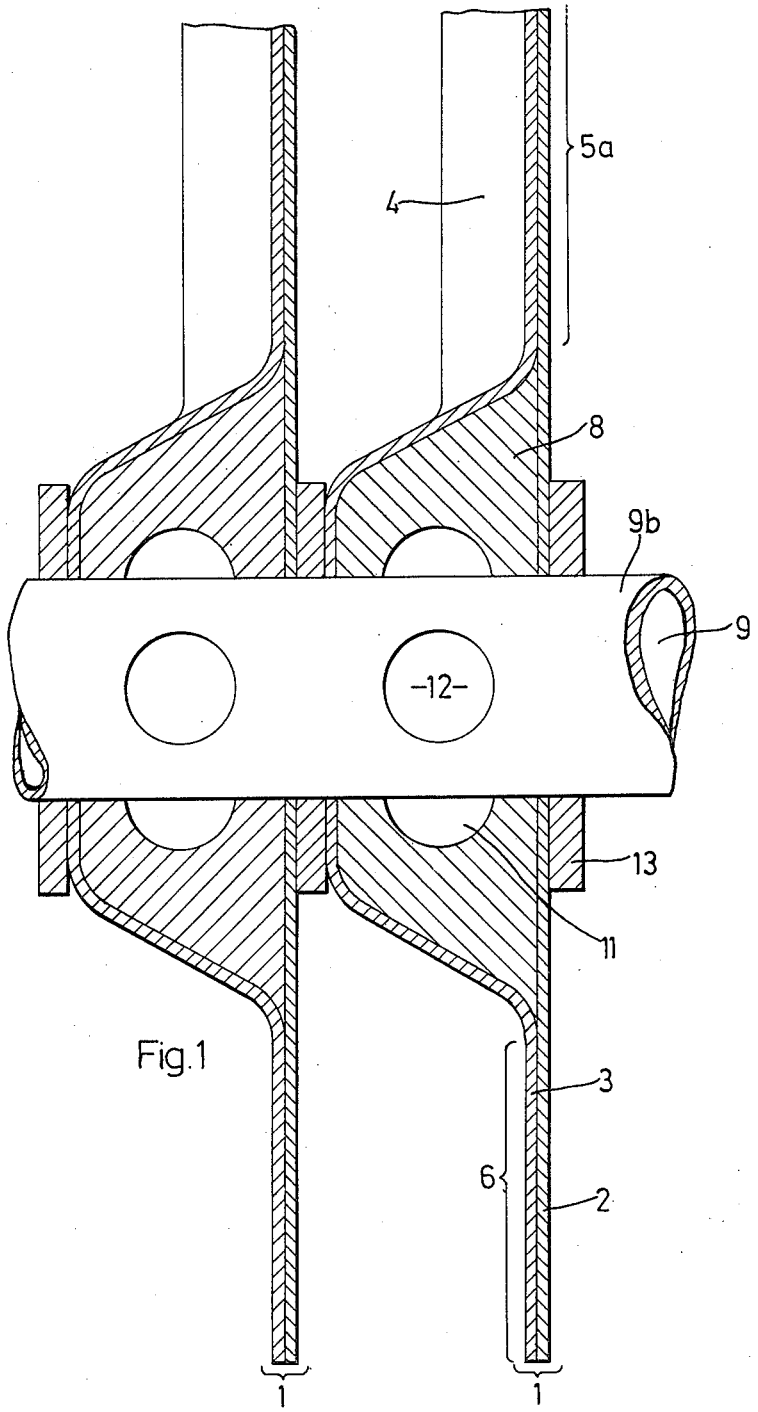
FIG. 1 is a partial section through two elements of a heat exchanger according to the present invention, showing the end closures inserted into the ends of the deeper manifolds, approximately through the line I—I in FIG. 2.

In the plate heat exchanger shown (though not completely), each heat exchange element 1 consists of a flat plate 2 and a deep-drawn or similarly deformed plate 3. Both plates consist of metal, preferably of aluminum, and the surfaces thereof facing each other are coated with a sealing adhesive material or provided with a suitable lacquer or adhesive whereby they can be tightly sealed together and, at the prevailing temperatures, permanently sealed together. Also, the outer surfaces of the plates can be provided with a suitable coating or lacquering (not shown).

Small passages 4 and, at both ends thereof, manifolds 7 for the feeding and discharge of the flowing medium to, and/or from the passages 4 are formed into the plate 3. The manifolds 7 are closed at their ends by end closures 8. On the flat areas 5 between the passages 4 and at the edges 5*a* and 6, the plates 2 and 3 are tightly sealed to each other. Also, the end closures 8 are sealed in between the two plates 2 and 3 so as to tightly close and seal the manifolds 7 at their ends.

Figure 2:
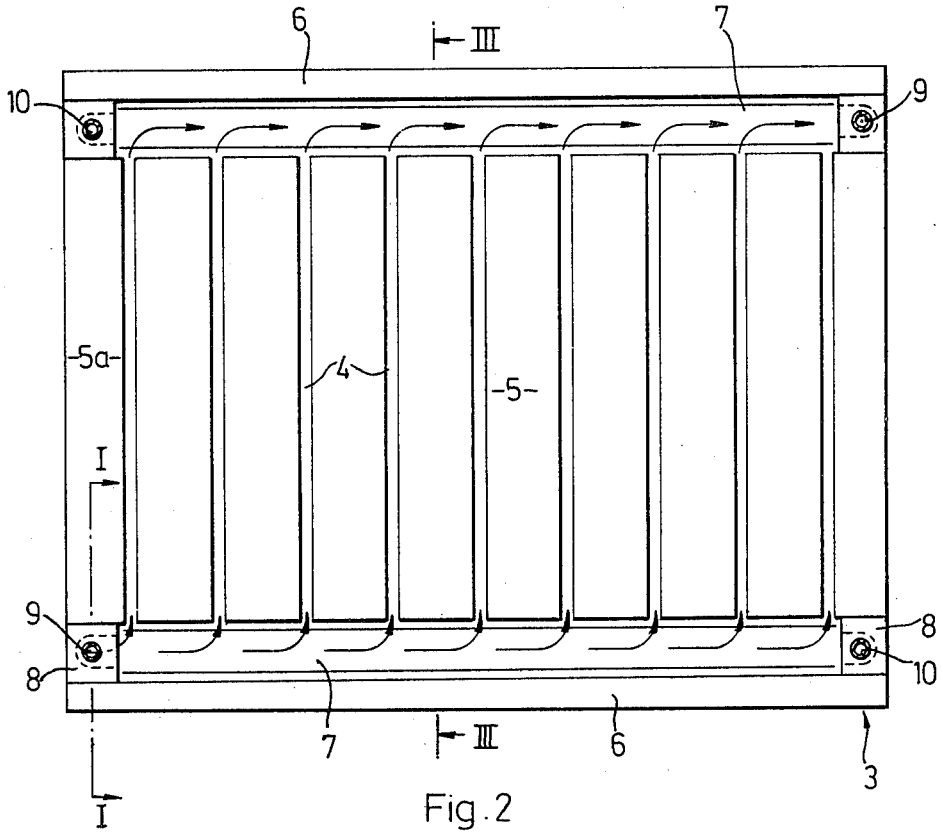
FIG. 2 is a deep-drawn plate with end closures.
Figure 3:
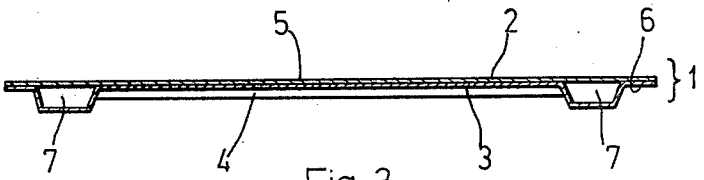
FIG. 3 is a section through an element approximately along the line III—III in FIG. 2.

In the end closures, positioned approximately at the corners of each element 1, means such as pipes 9*b* and 10 are inserted (see FIGS. 1 and 2). These pipes hold elements 1 of the heat exchanger together. The pipes 9*b*, functioning as distributing conduits 9, possess apertures 12, which lead into the channels 11 located in the end closures 8. As a result, the feeding and discharge of the medium can be effected through the distributing conduits 9 to several elements 1.

At the ends of the pipes 9*b* and 10, clamping or straining elements (not shown), such as e.g. screw joints and devices for pipe and tube connections, can be provided, by which all elements are tightly compressed. Advantageously, elastic sealing discs 13 are arranged on pipes 9*b* and 10 between the elements 1. In this case, the end closures 8 serve particularly for the closing and tight sealing of the manifolds 7. If a slight amount of the medium should creep along the outer periphery of the pipe 9*b*, the sealing discs 13 will still prevent it from leaking outside. The elastic sealing discs 13, and, if desired, also the end closures 8 can, however, also be so shaped as to effect the tight sealing of the elements 1 on the pipe 9*b* itself.

In one embodiment described by way of example and similar to the one shown in the drawings, the flat plate 2 consisted of aluminum having a thickness of about 0.07 mm and the plate 3 had been formed from 0.1 mm. thick aluminum. Both plates had been coated with about 0.05 mm. polypropylene. On the plate 3, the coating had been applied before the deformation. The pasages 4 had a depth of about 3 mm. and at an approximately trapezoidal cross-section, their average width was about 5 mm. The spacing between the centers of the passages 4 was about 24 mm. The manifolds had a depth of about 7 mm. and also a trapezoidal cross-section, with an average width of about 18 mm. The pipes **9*b* and 10, slid through the elements 1 at the four corners, had an outer diameter of 8 mm. The outer dimensions of each element 1 were 400 mm. in the direction of the manifolds 7 and 280 mm. in the direction of the passages 4, the distance between the centers of the manifolds 7** being about 230 mm. Heat exchangers comprising several elements of about these dimensions were preferred for air-conditioning apparatus and are particularly useful therein for the recovery of the heat contained in the outgoing air, water being used as the medium in the elements.

Figure 4:
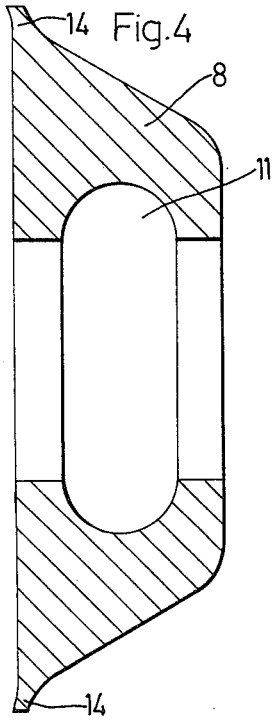
FIG. 4 is a section through an end closure.
Figure 5:
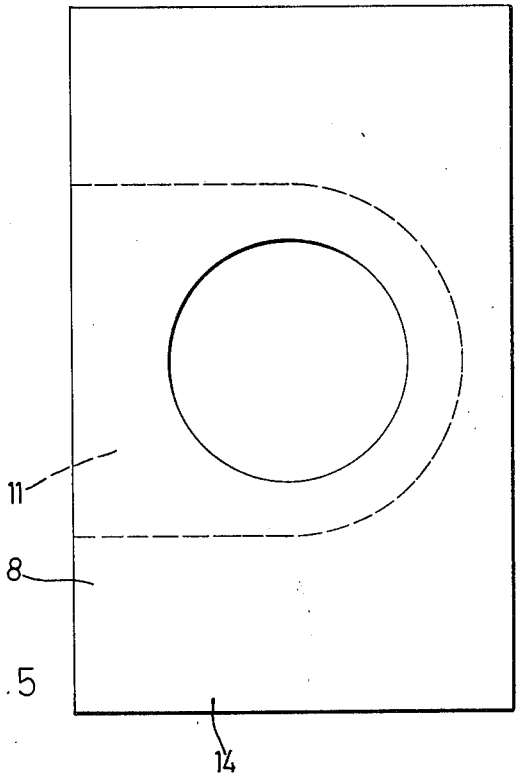

In FIGS. 4 and 5, an end closure 8 is shown which, for example, can be made by injection molding of a thermoplastic material such as polypropylene. In the heat exchanger described before, this part had a surface area of 16.5×24 mm. and a thickness of about 7.1 mm. At both edges of the end closure 8, which extend parallel to edge 6, an additional thickened flange of material 14 has been formed. This additional material is softened upon heat sealing the plates 2 and 3 and is thus plastically formed in between the two plates and the main section of the end closure 8, so that here, too, a fixed and tight connection is effected and even in the case of mass deviations in the parts, no loose spots can form.

Figure 6:
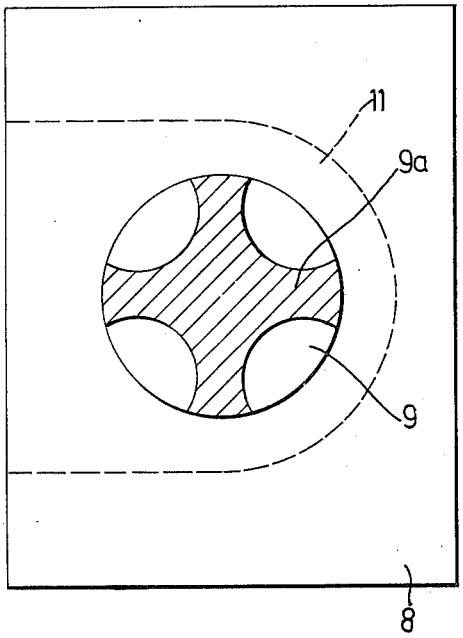
FIG. 6 is a view of another end closure with a section through a cross-shaped profile for connecting several elements.

In the end closures 8 shown in FIG. 6, a cross-shaped profile **9*a* has been inserted as a tie-rod. The medium here flows in the distributing conduits 9** between the arms of the cross.

Figure 7:
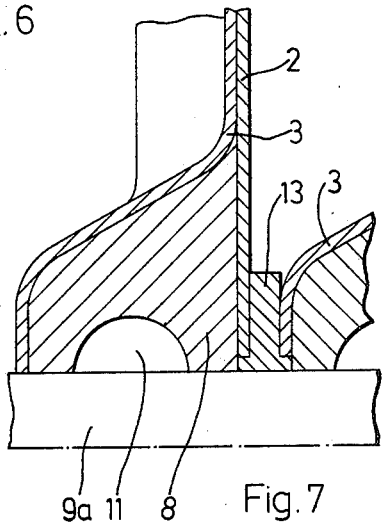
FIG. 7 is a section similar to FIG. 1.

In FIG. 7, the apertures in plates 2 and 3, through which, for example, a cross-shaped profile is inserted, are 1 to 3 mm. larger in diameter than corresponds with the periphery of the cross-shaped profile **9*a*. The cleft thus formed is largely filled up by the inner part of the elastic sealing ring 13**, when the elements of a heat exchanger are compressed by means of a tie rod and the screw joints (not shown).

The use of the invention is not, however, limited to the dimensions or the field of application mentioned before and a great many variations are possible with respect to materials employed as well as the dimensions and through-flow ratios. Furthermore, it is also possible to use more than 4 pipes **9*b* or 10 or conduits 9*a* in one exchanger, in which case any end closures 8 located in the path of manifolds 7 have to be provided with channels 11 leading to the opposed sides thereof. When both plates of an element have been deep-drawn, the cross-sections of the passages 4 and the manifolds 7** can be doubled. Thus it is, for example, also possible to use for heat exchangers very thin aluminum films of 0.04 to 0.075 mm. with sealable coatings, which can only be deformed relatively slightly by deep-drawing.

What is claimed is:

1. A plate heat exchanger, comprising heat exchange elements through which a medium flows, each heat exchange element consisting of two opposed thin metal plates, each plate coated with a sealing adhesive material on the surface thereof contacting the opposed plate and the abutting areas of the plates thereby being bonded together, at least one of said two plates being deep-drawn to form a plurality of parallel shallow passages therein and, on opposed ends of said passages, a deeper manifold being provided perpendicular to said passages for feeding and discharging the medium to and from said passages, the deeper menifolds extending along the whole length of the heat exchange element, and end closures having a cross section approximately corresponding to that of the deeper manifolds and comprising on at least the outer surfaces thereof, a material that can be sealed to the coated sides of the plates, the end closures being inserted into the ends of said deeper manifolds and sealed to the plates to thereby close said manifolds, distributing conduits running transversely to the plates of said heat exchange elements and through said end closures, said distributing conduits opening into channels which are provided in the end closures such that the medium can flow from one distributing conduit through an associated end closure into one of said manifolds connected to the ends of said passages and then through said passages to the other opposed manifold and into another distributing conduit in an associated end closure.

2. A plate heat exchanger as defined in claim 1 wherein the end closures are adapted to incompressibly fill that portion of said manifolds around the distributing conduits so as to absorb any tensions and pressures exerted in the direction of the axis of the distributing conduits without any deformation of the shape of said manifolds.

3. A plate heat exchanger as defined in claim 2 wherein means penetrating said end closures hold the heat exchange element together by way of tie-rods.

4. A plate heat exchanger as defined claim 1 wherein means penetrate said end closures to define said conduits.

5. A plate heat exchanger as defined in claim 4 wherein means penetrating the end closures to define the conduits are pipes having aperatures therein which open into the channels of said end closures.

6. A plate heat exchanger as defined in claim 1 wherein the end closures at the edges thereof which are parallel to the manifolds are provided with deformable flanges of material which, on connecting the plates, are plastically formed in between the latter, thereby tightly closing the ends of said manifolds.

* * * * *